US005421285A

United States Patent [19]

Shaper

[11] Patent Number: 5,421,285

[45] Date of Patent: Jun. 6, 1995

[54] MOVABLE SEAT FOR THE COXSWAIN IN A ROWBOAT

[76] Inventor: Lawrence Shaper, Box 153 B, Thetford Center, Vt. 05075

[21] Appl. No.: 248,225

[22] Filed: May 24, 1994

[51] Int. Cl.[6] ..... B63B 17/00

[52] U.S. Cl. ..... 114/363; 114/347

[58] Field of Search ..... 114/343, 347, 363; 440/101–105; 297/344.11, 354, 340

[56] References Cited

U.S. PATENT DOCUMENTS

| | | | |
|---|---|---|---|
| 391,939 | 10/1888 | Breese | 114/363 |
| 392,867 | 11/1888 | Kerns | 114/363 |
| 710,147 | 9/1902 | Goodwin | 114/363 |
| 1,058,855 | 4/1913 | Gerardin et al. | 114/363 |
| 5,067,426 | 11/1991 | Vespoli et al. | 114/347 |

FOREIGN PATENT DOCUMENTS

| | | | |
|---|---|---|---|
| 462870 | 6/1928 | Germany | 440/102 |

*Primary Examiner*—Edwin L. Swinehart
*Attorney, Agent, or Firm*—Longacre & White

[57] ABSTRACT

The invention is a system for decreasing the oscillating mass of a rowboat by decoupling the mass of the coxswain through the use of a movable seat.

6 Claims, 1 Drawing Sheet

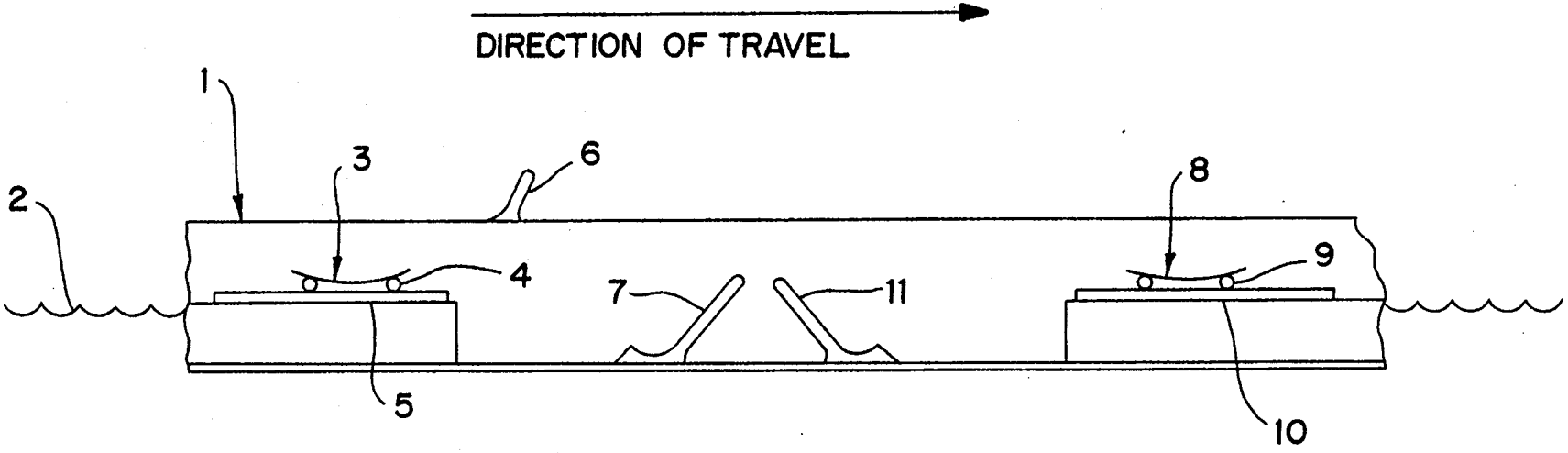
DIRECTION OF TRAVEL
1
2
3
4
5
6
7
8
9
10
11

MOVABLE SEAT FOR THE COXSWAIN IN A ROWBOAT

BACKGROUND OF THE INVENTION a) Field of the Invention

The invention concerns improving the efficiency of rowboats equipped with movable seats for the rowers by providing a movable seat for the coxswain as well. The coxswain is a person who can steer the boat but who is not permitted to have an oar. Movable seats in rowboats are used in order to allow the leg muscles to be employed in propelling the boat and to increase the length of the stroke. The rowers sit facing opposite to the direction of travel of the boat with their feet strapped to foot braces which are fixed in the boat, and they sit on a movable seat. The elbows are straightened, the waist and knees are bent, and the hands, holding the handle of the oar, are raised. This puts the blade of the oar in the water to complete the "return" ready for the beginning of the "drive". The knees are then straightened, and the elbows are bent thereby bringing the oar handle close to the chest. The hands are then lowered to bring the oar blade out of the water to end the "drive", and the process is begun again (elbows straightened, waist bent, knees bent, etc.).

The velocity of a rowboat is composed of three distinct and separate motions: the first two involve the center of mass of the boat plus coxswain plus rowers, and the third involves an internal oscillation. Each of the motions requires energy.

Motion 1: The average motion, Vavg, of the center of mass, which is equal to the distance moved per stroke (both drive and return), D, divided by the time for one stroke, t.

$$Vavg = D/t$$

The energy per stroke to perform this motion is required by the hydrodynamic resistance of the boat and has been found empirically to be approximately $$E_1 = CVavg^2D$$

where $E_1$ is the energy per stroke required for Motion 1, C is a constant determined by the shape and wetted surface area of the immersed hull of the boat, Vavg is the average motion of the boat, and D is the distance moved per stroke.

Motion 2: A sawtooth motion of the center of mass which is a result of the fact that the driving force is applied by the rowers in pulses-only on the drive and not on the return. The center of mass must be accelerated with every drive. If, from the end of one drive to the beginning of the next, the center of mass slows down, due to the hydrodynamic resistance, by an amount $V_s$, then the energy required to accelerate back to the speed at the end of the first drive is $$E_2 = \tfrac{1}{2} M_T V_S^2$$

where $E_2$ is the energy per stroke required by Motion 2, $M_T$ is the total mass of the boat plus coxswain plus rowers, and $V_S$ is the increase in speed between the beginning of the drive and the end of the drive.

Motion 3: An internal oscillation between two masses: on the one hand, the mass of the boat plus coxswain, and on the other, the mass of the rowers. The oscillation is driven by the legs of the rowers, alternately driving the boat and coxswain away from them on the drive and pulling the boat and coxswain to them on the return. The energy required to perform this motion is $$E_3 = \frac{1}{2} V_o^2 \left( \frac{mM}{m + M} \right)$$

Where $E_3$ is the energy per stroke required to accelerate the masses toward and away from each other, $V_0$ is the maximum velocity of separation or contraction of the masses, m is the mass of the boat plus coxswain, and M is the mass of the rowers.

No matter what system of propulsion is used, the energy to perform Motion 1 will always be required (although boat designers are continually trying to reduce the constant C by altering the hull shape).

The energy to perform Motion 2 could be eliminated if the force could be applied continuously instead of in pulses; if, for instance, multiple rowers rowed in phases instead of in unison.

The energy to perform Motion 3 could be eliminated if a system of propulsion were used which did not entail the oscillation of large masses. If, for instance, the "rowers" sat on fixed seats and pedaled a gear driven propeller, the oscillating mass would be greatly reduced. (The necessity of reducing the oscillating mass of boat plus coxswain in traditional rowboats has been known for more than one hundred years. This is evidenced by the development of extremely light boats and the use of the lightest possible coxswains. The desire to reduce this mass has been so great that associations regulating rowing races have set minimum weights for boats in order to assure their durability and safety, and minimum weights for coxswains in order to assure their health and availability.)

The invention described here is intended to reduce only the energy required from the rowers to perform Motion 3 in rowboats rowed in the traditional manner: in unison and with oars and movable seats for the rowers. The mass of the coxswain will still adversely effect the speed of the boat through the energies required by Motion 1 and Motion 2.

Observation of a conventional racing shell in motion clearly shows Motion 3, the coxswains head and torso being jerked forward and backward by motion 3, and the coxswain bracing herself with hands and legs against the thrust of this motion. Using the invention described here, if the coxswain only relaxes and lets the boat oscillate under her, her mass will be decoupled from the oscillation of Motion 3, thereby reducing m, thereby reducing $E_3$.

If instead of merely relaxing, the coxswain were to pull the boat away from the rowers during the drive and push the boat toward the rowers on the return, using the foot braces and projecting handles described here, she would be helping the rowers to perform Motion 3 upon the remaining mass m, the boat. Although coxswains in traditional rowboats have braced themselves by holding the upper edge of the boat, there has been no need or use for projecting handles described here which are used by the coxswain to help oscillate the boat, because such help was not possible without the movable seat described here. The active participation of the coxswain in oscillating the boat would not eliminate the rest of the energy required to perform Motion 3, but shift the energy requirement from the rowers to the coxswain.

It should be noted that this invention does not permit the coxswain to propel the boat; without an oar she can only effect the internal oscillation about the center of mass. It is only indirectly, through the reduction of this parasitic energy drain upon the rowers, that the speed of the boat is increased.

Observation of rowboat races shows clearly that all of the energy available to the rowers is used during a race. Vomiting and fainting by the rowers at the end of a race is not uncommon. Therefore, any energy requirement removed from the rowers, such as that described here for Motion 3, will be applied by them toward moving the oars more quickly through the water, thereby increasing the speed of the boat.

b) Description of Related Art

There have been many patents granted in the area of improving the characteristics of moving seats for rowers; see U.S. Pat. Nos. 391,939; 392,867; 710,147; 1,058,855. German Patent 462,870 shows a system for rowing while facing forward. Movable seats for rowers have been in use for more than 100 years, although I am unaware of anyone who has thought of positioning a movable seat under the coxswain. The principle of lowering the oscillating mass, described here, has been employed by using moving oarlocks instead of moving seats. Although a rower's oar may break, thereby turning a rower into a non-rower with a movable seat, that would still leave the mass of the coxswain coupled to the boat and requiring the energy sought to be eliminated by this invention. This invention is not for the movable seat, but for the movable seat positioned under a person who is not permitted to have an oar, broken or not, namely, the coxswain.

SUMMARY OF THE INVENTION

The objective of the present invention is to provide a movable seat for the coxswain in a rowboat equipped with movable seats for the rowers. If the coxswain sits upon a movable seat, she can allow the boat to move under her instead of oscillating with the boat, thereby reducing the oscillating mass and the energy required of the rowers to produce the oscillations. This energy not expended by the rowers to oscillate the boat can be used to propel the boat. In addition, should the coxswain be so inclined, she can use her muscles to help oscillate the boat, thereby liberating more of the energy of the rowers for use in propelling the boat. The coxswain can apply herself toward oscillating the boat through the foot braces described and also through the handles appropriately positioned for that purpose. Because, until the invention described here, coxswains did not move, there was no need for handles. With the use of the movable seat described here, the coxswain, unlike the rowers whose hands are occupied with the oars, may use the hands and arms as well as the feet to oscillate the boat. More importantly, the legs as well as the torso can be placed on the movable seat and only the hands and arms used to oscillate the boat. This method has the advantage of further reducing the oscillating mass by decoupling the legs of the coxswain, which are heavier than the arms, from the oscillating motion of the boat.

BRIEF DESCRIPTION OF THE DRAWING

The drawing is a partial longitudinal section of a rowboat equipped with movable seats for a coxswain and a rower.

DESCRIPTION OF THE PREFERRED EMBODIMENT

This invention will most likely find use in a racing rowboat in which there is one coxswain, and one to eight rowers. The rowers face opposite to the direction of travel of the boat and the coxswain faces the direction of travel of the boat. The drawing is a partial longitudinal section of such a boat 1., floating upon water 2., traveling to the right as indicated by the arrow, and having a movable seat 3., for the coxswain, which seat rolls upon wheels 4., which roll in tracks 5. Handles 6., for the coxswain to grip with her hands, are non-movably attached to the sides of the boat so that she may use her arms to pull herself forward and back along the tracks. Foot braces 7., in which to secure the feet are positioned in front of the tracks so that the coxswain may use her leg muscles to move herself along the tracks. The handles 6., the foot stretchers 7., and the tracks 5., although adjustable in position to suit the anatomy of a particular coxswain, are all non-movably attached to the boat 1., when in use. The seat 3., by virtue of the wheels 4., is free to move, but only forward and back (longitudinally), being so constrained by the tracks 5. The usual arrangement for a typical rower facing opposite to the direction of travel is shown with seat 8., having wheels 9., which roll upon tracks 10. The foot braces for the rower 11., are placed in the opposite position relative to the direction of travel of the boat than are the foot braces for the coxswain, because the rower is facing in the direction opposite to that of the coxswain.

What is claimed is:

1. A rowboat having a particular direction of travel, said rowboat comprising a movable seat for a coxswain said movable seat being constrained to motion along a longitudinal axis aligned with the direction of travel of said rowboat.

2. The rowboat according to claim 1, further comprising: at least one movable seat for at least one person rowing the rowboat.

3. The rowboat according to claim 2, wherein said coxswain faces the direction of travel of the rowboat.

4. The rowboat according to claim 1, further comprising: projecting handle means for grasping by the coxswain, said projecting handle means are non-movable fixed to said rowboat.

5. The rowboat according to claim 2, further comprising: projecting handle means for grasping by the coxswain, said projecting handle means are non-movable fixed to said rowboat.

6. The rowboat according to claim 3, further comprising: projecting handle means non-movably fixed to the rowboat, for grasping by the coxswain.

* * * * *